US008033480B2

(12) United States Patent
Höhne et al.

(10) Patent No.: US 8,033,480 B2
(45) Date of Patent: Oct. 11, 2011

(54) ARRANGEMENT FOR FASTENING RAILROAD RAILS TO A SLEEPER

(75) Inventors: Hubertus Höhne, Butzbach (DE); Hans-Ulrich Dietze, Wusterwitz (DE); Heinz Ossberger, Grosslobming (AT); Josef Leitner, Weisskirchen (AT); John Porrill, Godalming (GB); David R. Seeley, Bengeo (GB)

(73) Assignees: BWG GmbH & Co. KG, Butzbach (DE); VAE GmbH, Vienna (AT); Pandrol Limited, Addlestone Surrey (GB); VAE Eisenbahnsysteme GmbH, Zeltweg (AT)

( * ) Notice: Subject to any disclaimer, the term of this patent is extended or adjusted under 35 U.S.C. 154(b) by 350 days.

(21) Appl. No.: 10/599,878

(22) PCT Filed: Apr. 28, 2005

(86) PCT No.: PCT/EP2005/004565

§ 371 (c)(1),
(2), (4) Date: May 29, 2007

(87) PCT Pub. No.: WO2005/106124

PCT Pub. Date: Nov. 10, 2005

(65) Prior Publication Data

US 2007/0246559 A1 Oct. 25, 2007

(30) Foreign Application Priority Data

Apr. 29, 2004 (DE) ..... 10 2004 021 091

(51) Int. Cl.
*E01B 9/00* (2006.01)

(52) U.S. Cl. ..... 238/315

(58) Field of Classification Search ..... 238/310, 238/315, 316, 321, 338, 355, 264, 269
See application file for complete search history.

(56) References Cited

U.S. PATENT DOCUMENTS 3,724,754 A * 4/1973 Molyneux et al. ..... 238/349
4,802,623 A * 2/1989 Fasterding et al. ..... 238/44
5,566,882 A * 10/1996 Brown et al. ..... 238/343
6,572,027 B1 * 6/2003 Pilesi et al. ..... 238/310

* cited by examiner

*Primary Examiner* — Joe Morano, IV
*Assistant Examiner* — R. J. McCarry, Jr.
(74) *Attorney, Agent, or Firm* — Dennison, Schultz & MacDonald

(57) ABSTRACT

Fastening for a rail and arrangement for fastening of rails The invention relates to a fastening for a rail for securing a rail (10) whose foot is resting on a concrete sleeper (16), comprising at least one elastic clip (20) having several legs of which at least one leg extends inside a shoulder (42, 44) or channel of a holder (24) that is connected to the concrete sleeper, and at least one further leg rests on the rail foot. For securing a rail to the necessary extent with simple design means and in space-saving form, it is suggested that the holder (24, 26) is arranged detachably in the concrete sleeper (16) or in a plate element resting thereon and is connected to the concrete sleeper by a bolt element.

20 Claims, 14 Drawing Sheets

Section A-A

Section A-A

160

ARRANGEMENT FOR FASTENING RAILROAD RAILS TO A SLEEPER

The invention relates to a fastening for a rail whose foot is indirectly or directly resting on a concrete sleeper, comprising an elastic clip having several legs of which at least one leg extends inside a receptacle such as a shoulder or channel of a holder that is connected to the concrete sleeper, and at least one further leg rests on the rail foot.

Furthermore, the invention relates to an arrangement for fastening of rails having rail feet and resting on concrete sleepers in the area of a points or crossing comprising several clips emanating from holders with at least first and second legs, where the first legs of the clips are fixed inside one or more receptacles such as shoulders or channels in the respective holders and the second legs of at least some of the clips rest on the rail feet.

A rail fastening with an elastic clip is described in EP-B-0 619 852. In a plan view the clip has approximately the form of an M and comprises two outer legs and two inner legs connected to one another by arc sections. The outer legs are fixed in receptacles of a holder, while the inner legs or the arc connecting them rest on a rail foot. The holder has two shoulders at a distance from one another with channel-like openings designed in U-shape as the receptacles, into which the ends of the outer legs can be driven in order to then hold down the rail to be secured using the inner legs with the required pre-tension. The holder can either be cast into a concrete sleeper via a spigot or be connected to a ribbed plate, for example by welding.

A clamp of E-shape when seen in a plan view for fastening a rail is known from AT-C-350 608. To fix the clamp, a leg is knocked into a channel of an anchoring member that in its turn is integrally cast in a concrete sleeper.

A clip having a W-geometry is shown in DE-C-39 18 091. Sections of the clip are fixed in a channel-like recess of an angular guide plate. Opposite sections of the clip support on a rail foot. The clip itself is connected to a concrete sleeper by a through-bolt.

Previously known rail fastenings with clips of the type described previously have the drawback that insufficient space is available for positioning and securing the clips, in particular in the areas of points and crossings where rails run close together. For that reason, special designs are generally needed for fastening of the rails in these areas.

The problem underlying the present invention is to develop a rail fastening and an arrangement for fastening of rails in such a way that they can be secured to the necessary extent with simple design means and in space-saving form.

To solve the problem, a rail fastening is proposed that is substantially characterized in that the holder is arranged detachably in the concrete sleeper or in a plate element resting thereon and is connected to the concrete sleeper by a bolt element.

Unlike previously known sleeper fastenings, a holder with a clip is proposed that extends at least in sections inside the holder, where the holder can be inserted detachably in a concrete sleeper or a plate element such as a ribbed plate or raised part in the area of a tongue heel and then connected by a bolt element such as a through-bolt to the concrete sleeper. Here the head of the bolt element extends underneath the leg(s) resting on the rail foot or an element by which one or more rail feet are secured.

Designing the holder to be detachable and hence replaceable results in a high flexibility for positioning the holder and in the possibility of easy replacement in the event of damage.

In contrast, holders are used in the case of clamps having an M- or E-shaped geometry that are connected firmly, i.e. permanently to the concrete sleeper or a ribbed plate.

It is provided in a noteworthy embodiment of the invention that the holder is arranged in the concrete sleeper in an insert consisting of electrically insulating material. Here the holder engages positively in the insert, which preferably has a cross-section differing from a circular geometry. This offers the possibility of the insert integrally cast in the concrete sleeper being aligned during casting such that the holder receiving the clamp and engaging positively in the insert is aligned with the rail in the correct position so that the clip emanating from the holder can thus rest to the required extent on the rail foot and hence secure the rail.

The insert is connected to the bottom plate of the mould during casting of the concrete sleeper preferably by extensions which are separated from the insert when the bottom plate is removed. This ensures that the insert has the correct orientation to the rail to be arranged on the concrete sleeper.

In particular, the insert has in sections a hollow cylinder geometry with diametral projections assigned to corresponding projections in the holder, so that the latter are aligned with the rail in accordance with the insert.

In particular, the holder has a base section with shaped extension on the bottom and with its outer geometry matched to the inner geometry of the insert. The shaped extension preferably has a cylindrical disc geometry with projections following a cylinder section geometry.

Two shoulders each receiving a leg section of the clamp can extend from the base section of the holder, where the bolt element such as a through-bolt passes between the shoulders. The leg(s) of the clip resting on the rail foot or the element extend between the shoulders, by which rail feet running next to one another are to be secured.

The insert electrically insulating the holder from the concrete sleeper should furthermore have on the bottom a sleeve-like section running vertically to the longitudinal axis of the concrete sleeper and inside which the shank of the bolt element extends in sections.

If the holder is not inserted directly into the concrete sleeper, but into a plate element such as a ribbed plate or in an intermediate plate permitting a height increase in the area of the tongue heel, the intermediate plate contains a receptacle positively receiving the holder. The shaped extension too is preferably positively received here, with the underside of the base section of the holder resting on the plate element.

If the plate element is an intermediate plate forming a height increase in the area of a tongue rail, it should have a through opening with a cross-section corresponding to the shaped extension of the holder. For support of the holder on the bottom, a spacer of preferably electrically insulating material extends in the through opening and emanates from an insert integrally cast in the concrete sleeper and possibly having a sleeve-like continuation on the bottom through which passes the shank of a bolt element. In order for the spacer element to have a sufficient stiffness, it has outer and inner walls running concentrically to each other that are connected by radial webs.

According to a per se inventive proposal of the invention, it is provided that the base section of the holder is arranged between two rail feet, that two pairs of shoulders emanate from the base section, that a clip emanates from each pair of shoulders and that a plate element adjustable relative to the base element and resting on the rail feet passes between two pairs of shoulders, on which plate element rests at least one leg of each of the clips.

Instead of two pairs of shoulders, two channel-like receptacles spaced to each other can emanate from the base section in order to receive a leg of a clip having an E-shape in the plan view, as described in AT-C 350 608.

With this design, secure holding down of rails is easily possible which run directly next to one another as is the case in the area of points and crossings.

The base section having the two pairs of shoulders or the two channels preferably has a block-like geometry, where a shaped extension having a geometry of rectangular section with rounded corners emanates from the base section and engages positively in a corresponding second insert integrally cast in the concrete sleeper. The geometry of the insert or shaped extension thus ensures that a clear orientation of the holder to the rails is obtained.

The corresponding insert receiving the shaped extension of rectangular section has an outer section flush with the outer surface of the concrete sleeper and supporting the base section on the bottom and having in the central part a recess positively receiving the shaped extension, from which recess emanates a sleeve-like section through which passes the bolt element.

To achieve an adequate stiffness of the insert, radial stiffening ribs are provided on the underside along the outer section.

An arrangement for fastening of rails having rail feet and resting on concrete sleepers in the area of a points or crossing, comprising several clamps originating from holders with at least first and second legs, where the first legs of the clips are fixed inside one or more receptacles such as shoulders or channels in the respective holders and the second legs of at least some of the clips rest on the rail feet, is characterized in that first holders are positively received by first inserts integrally cast in the concrete sleeper and detachably connected to the concrete sleepers by bolt elements, in that second holders are positively arranged in recesses of plate elements arranged on concrete sleepers and are detachably connected to the concrete sleepers by bolt elements, and/or that third holders are positively arranged in through openings provided in intermediate plates supporting heel area of a tongue rail supported on the bottom by spacer elements and detachably connected to concrete sleepers using bolt elements, and in that fourth holders are each arranged between rails running directly next to one another, in that the fourth holders are positively received by second inserts cast in concrete sleepers and detachably connected to the concrete sleepers by bolt elements, and in that two clips emanate from every fourth holder and each rest on a second intermediate plate arranged movably relative to the fourth holder and in turn rest on the rail feet running directly next to one another. Here the first, the second and the third holders can be of identical design.

The first and second inserts preferably comprise electrically insulating material in order to insulate the holder electrically from the concrete sleeper.

Further details, advantages and features of the invention are shown not only in the claims and in the features they contain—singly and/or in combination—but also in the following description of preferred embodiments shown in the drawing.

Figure 1:
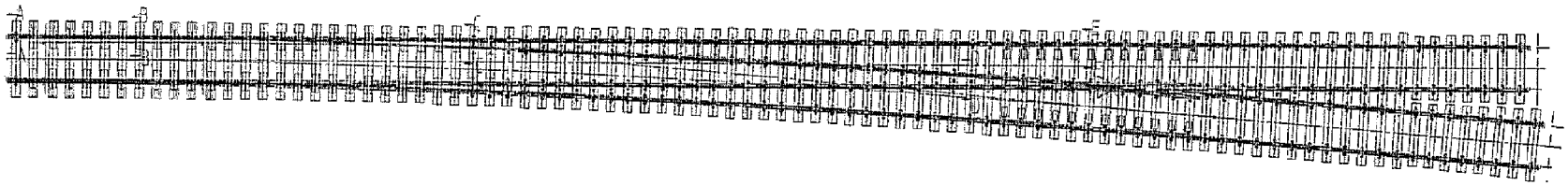
FIG. 1 shows a layout plan of a track switch.
Figure 2:
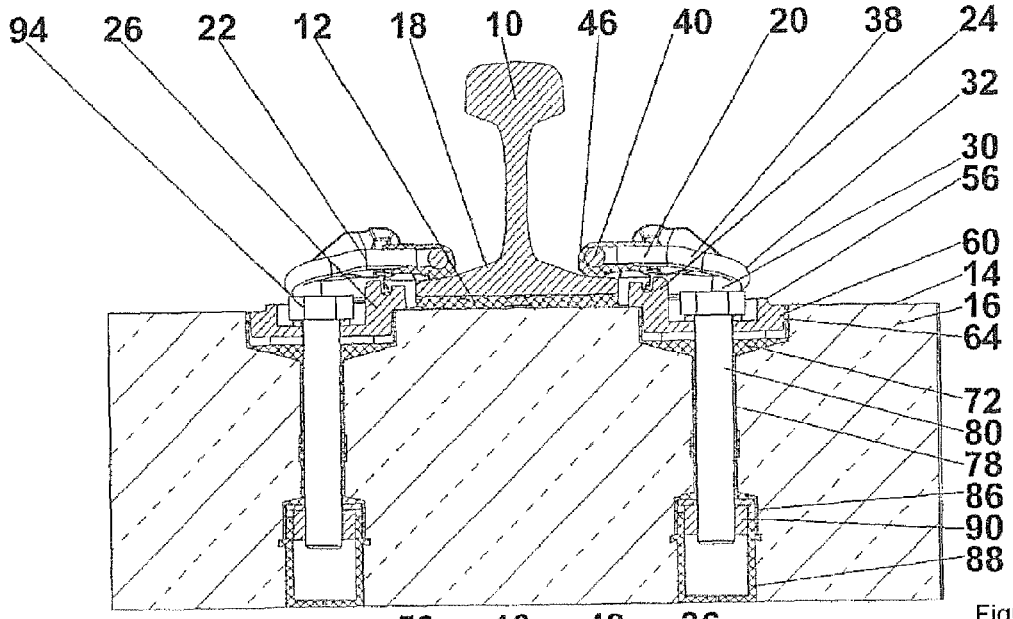
FIG. 2 shows a section along the line A-A in FIG. 3.
Figure 3:
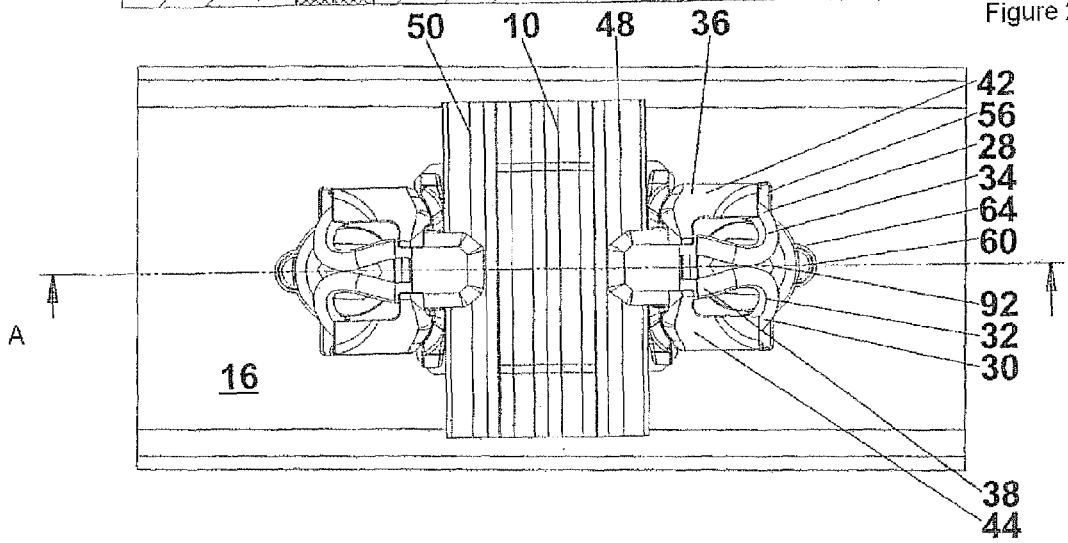
Figure 4:
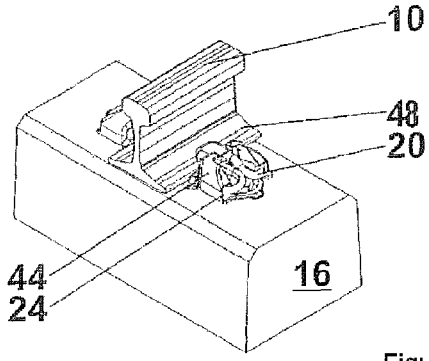
Figure 5:
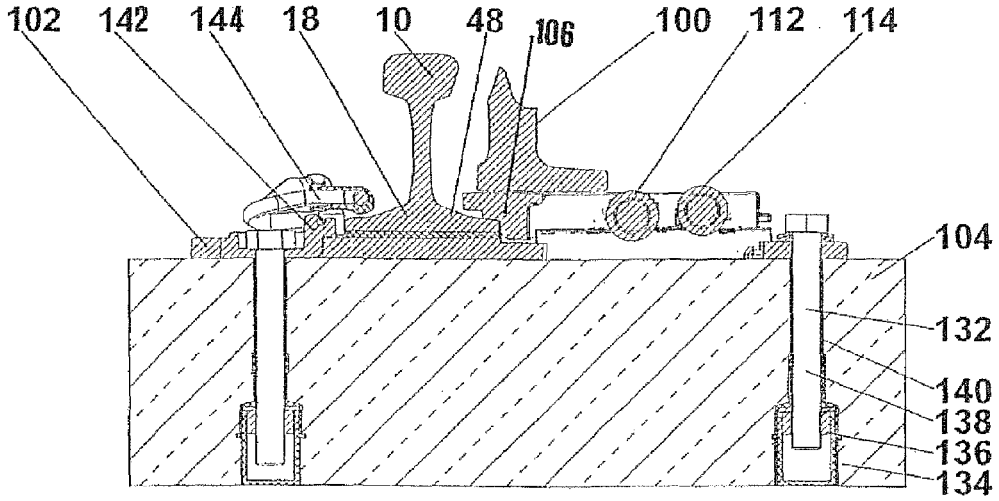
Figure 6:
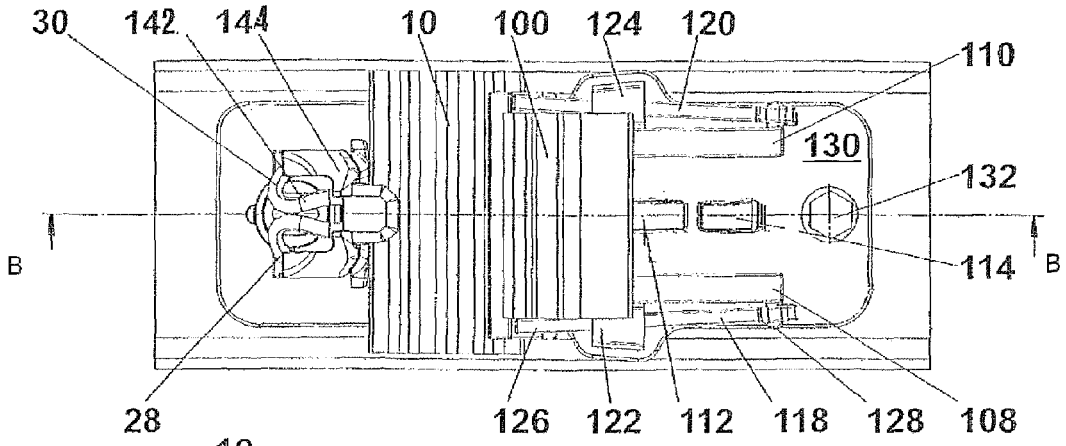
Figure 7:
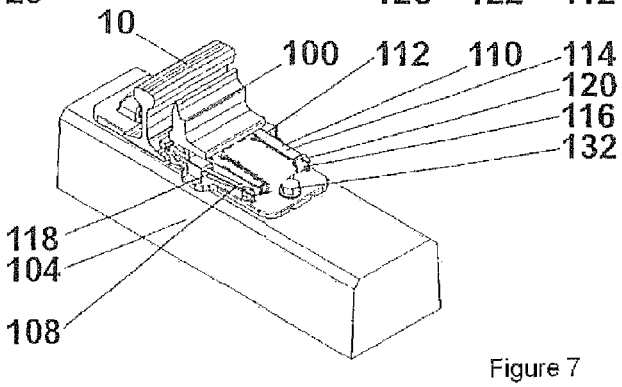
Figure 8:
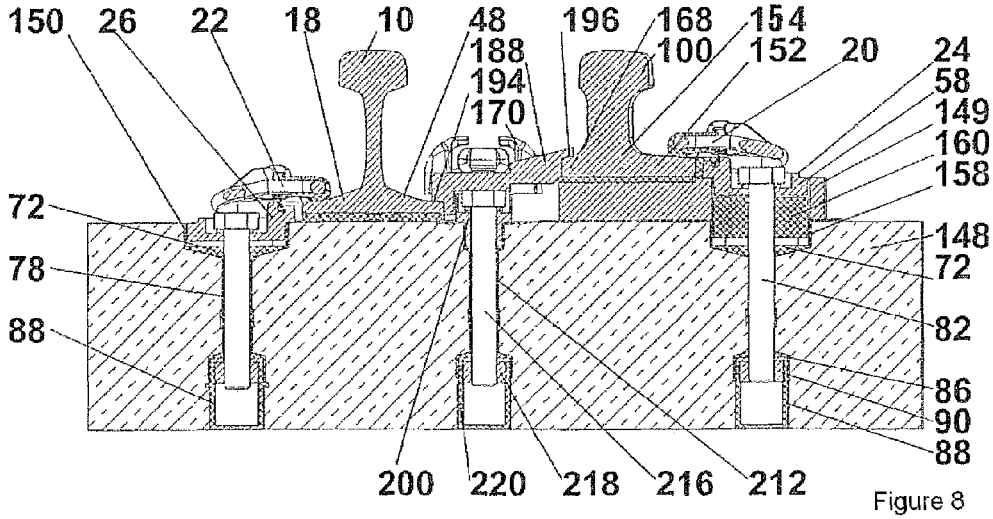
Figure 9:
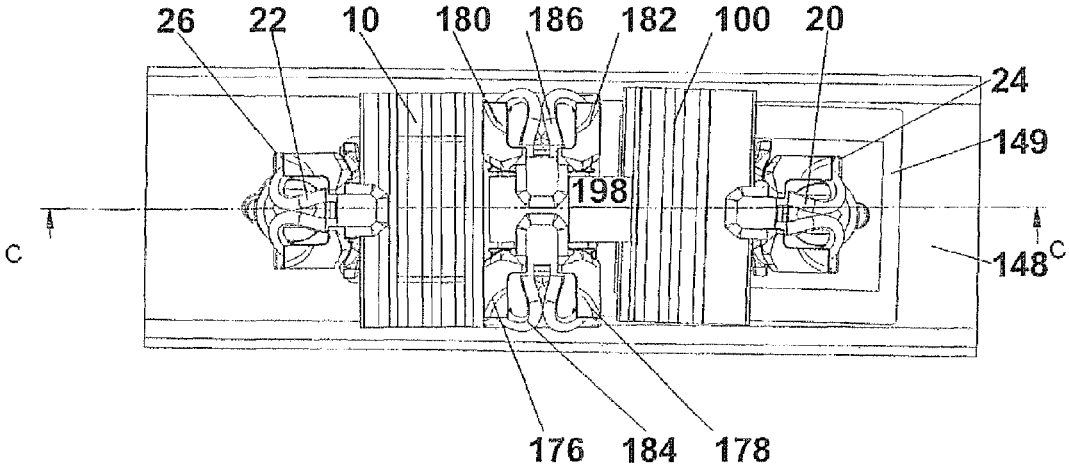
Figure 10:
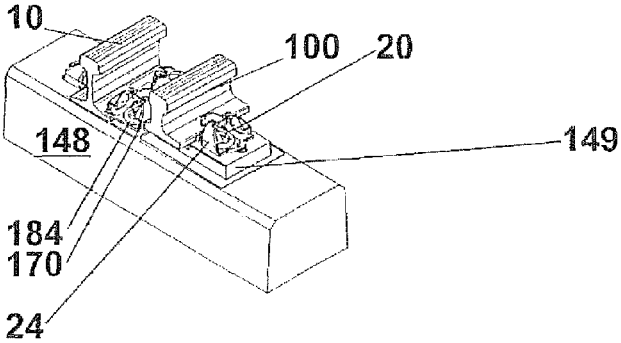
Figure 11:
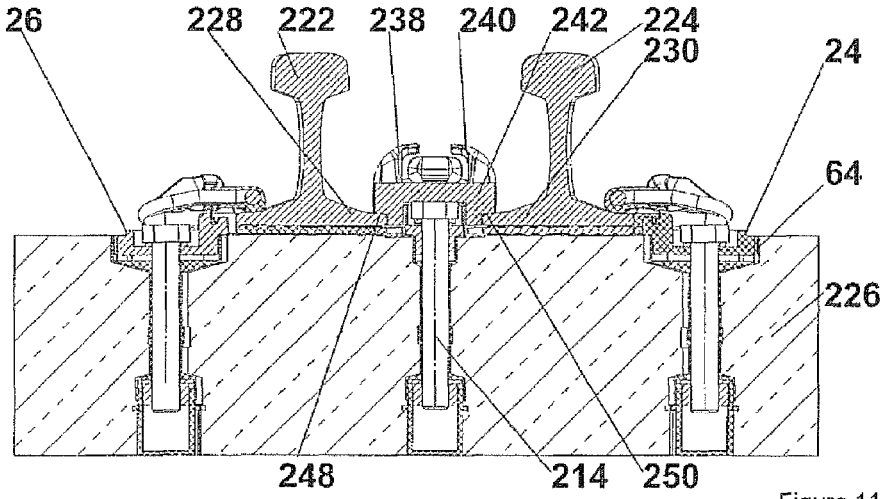
Figure 12:
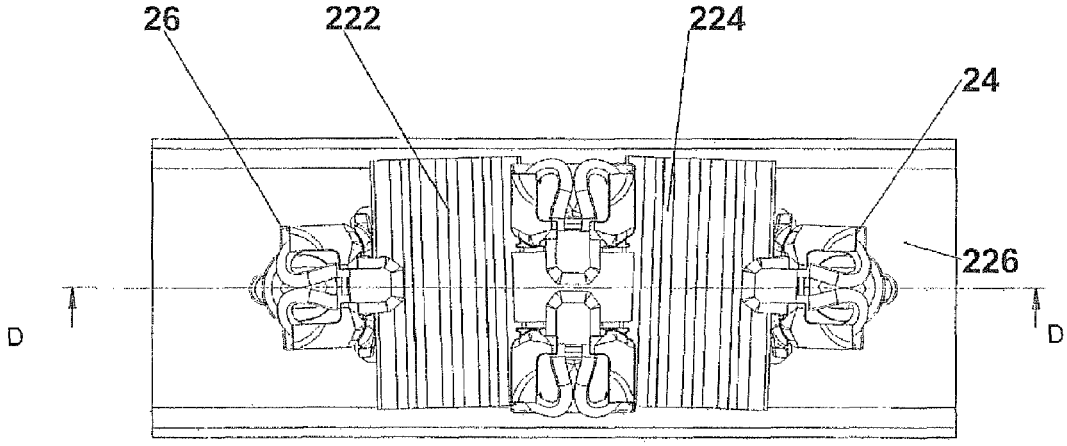
Figure 13:
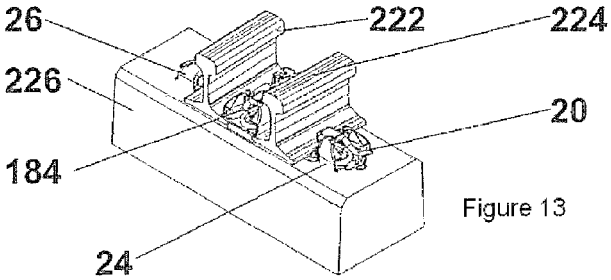
Figure 14:
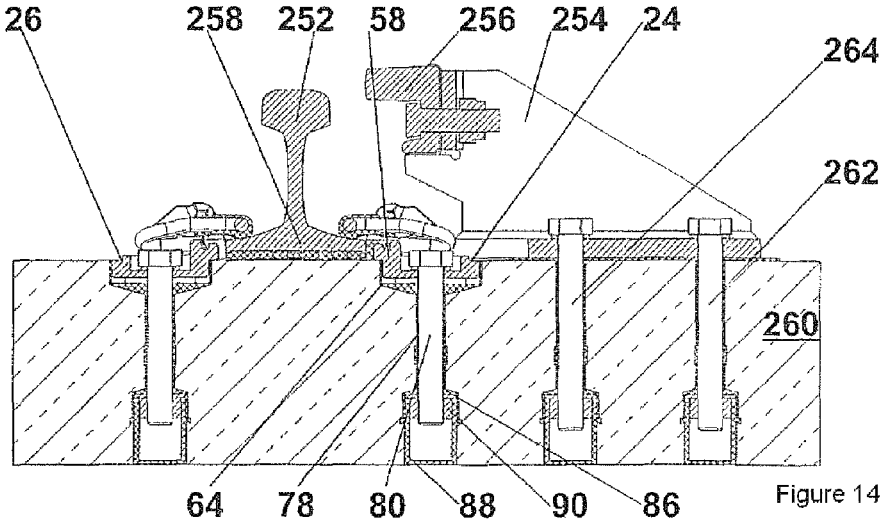
Figure 15:
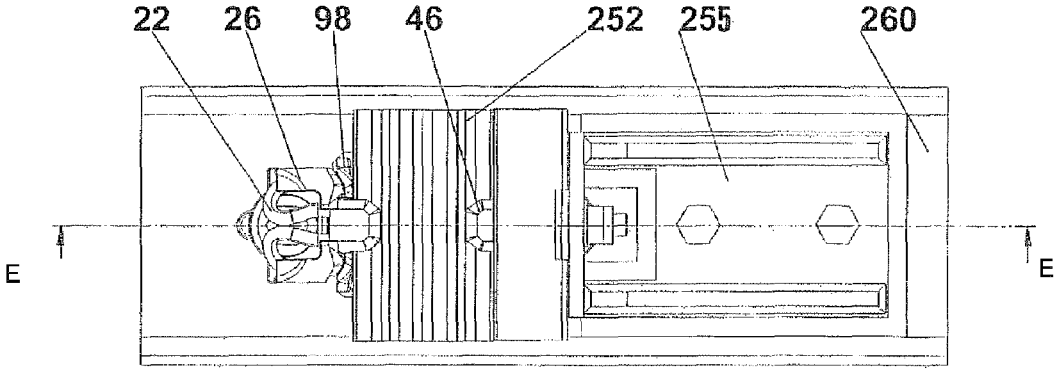
Figure 16:
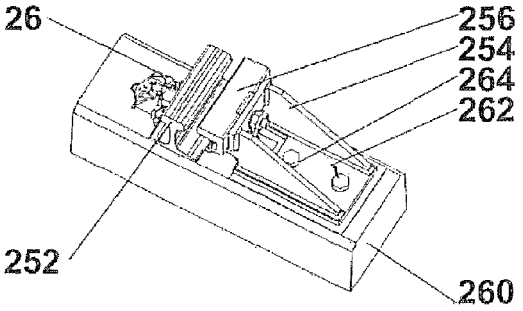
Figure 17:
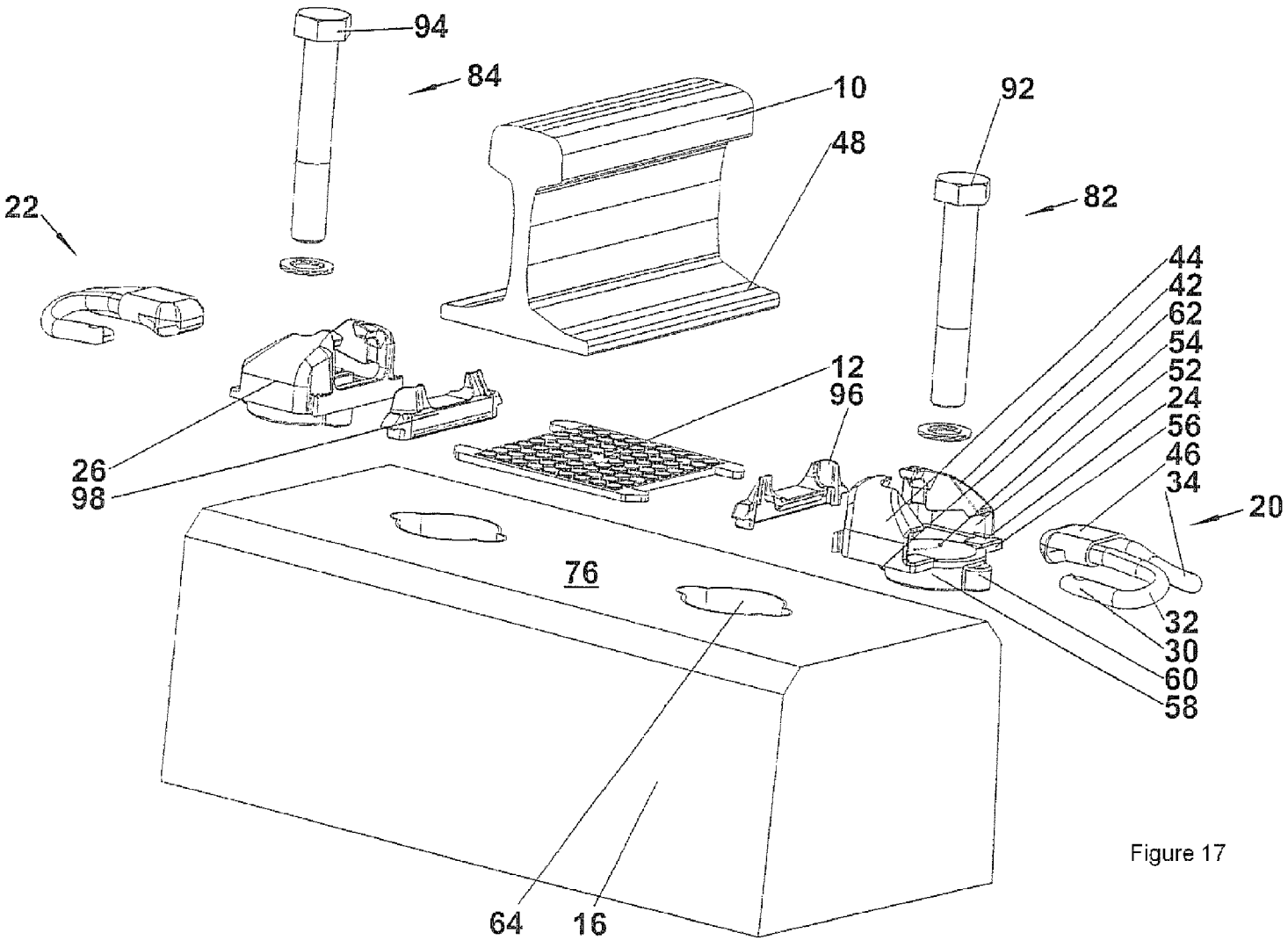
Figure 18:
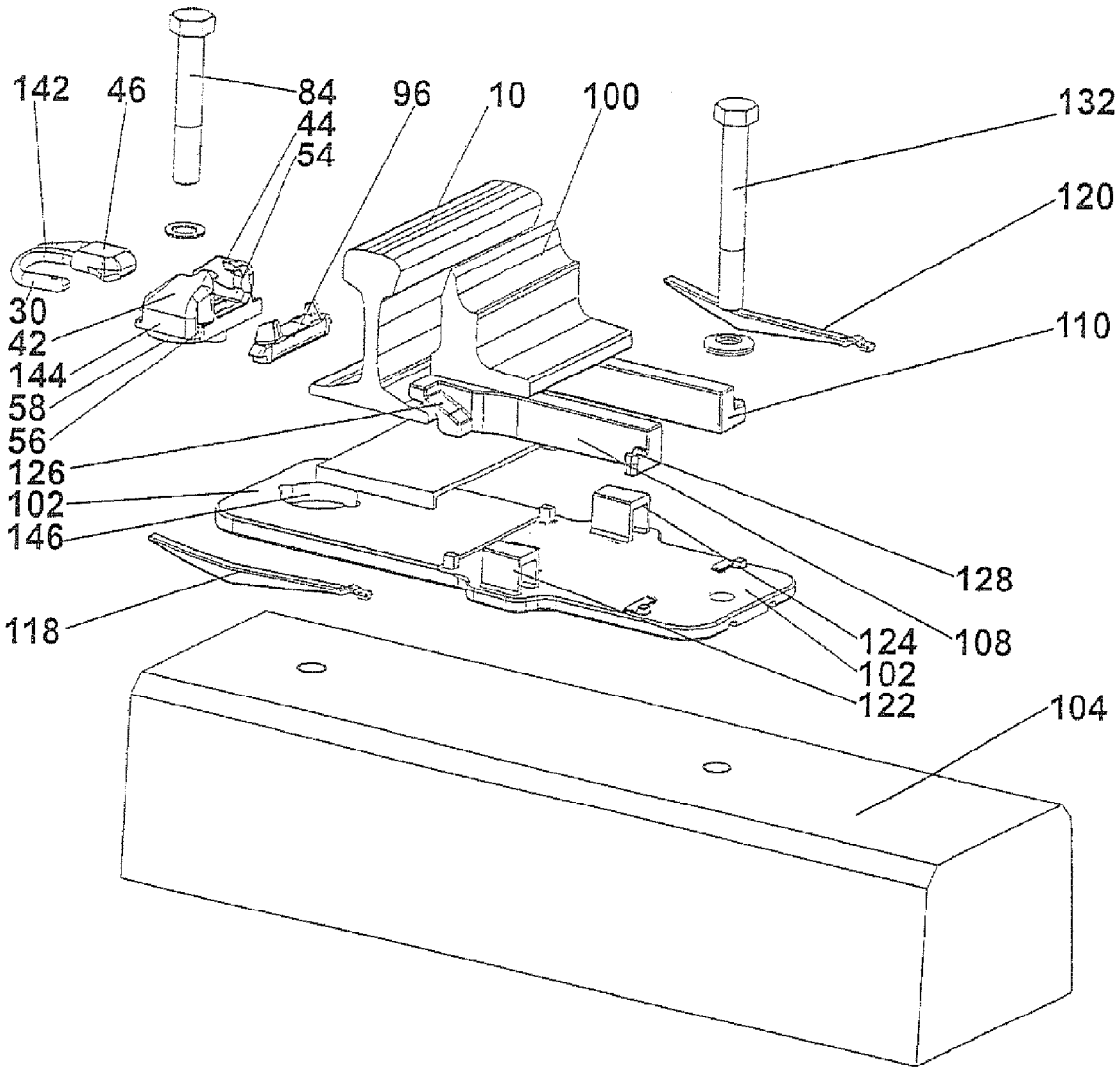
Figure 19:
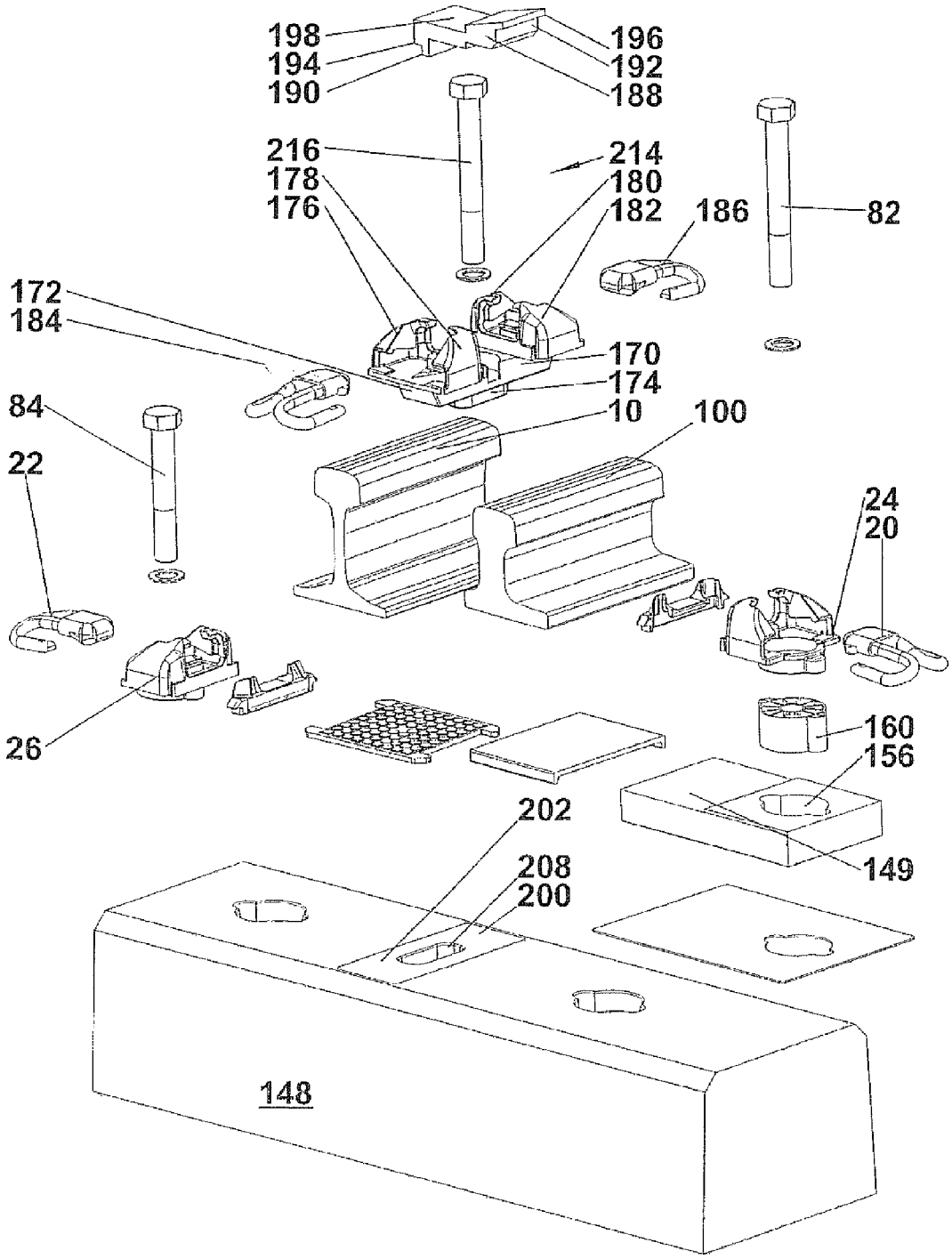
Figure 20:
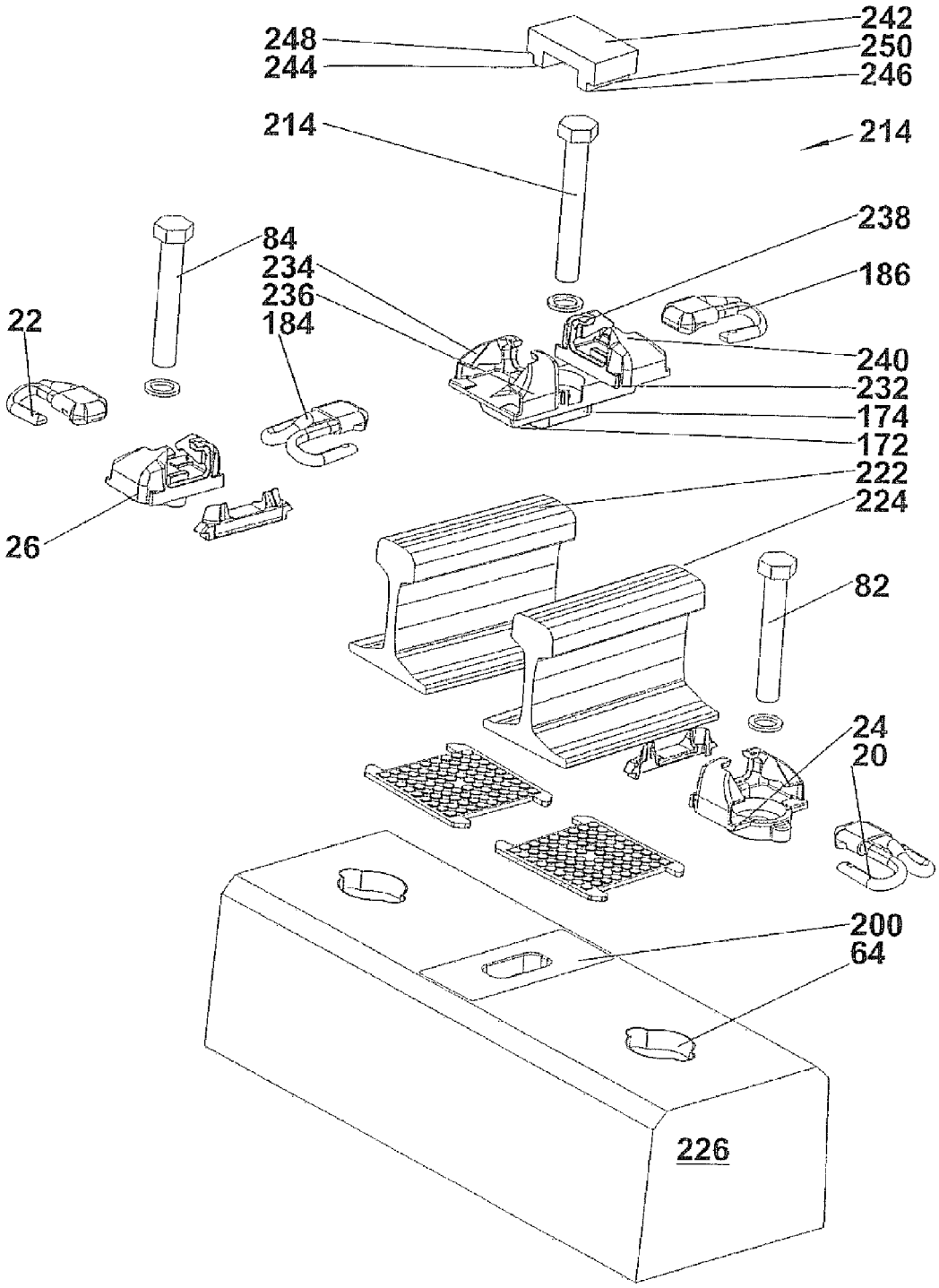
Figure 21:
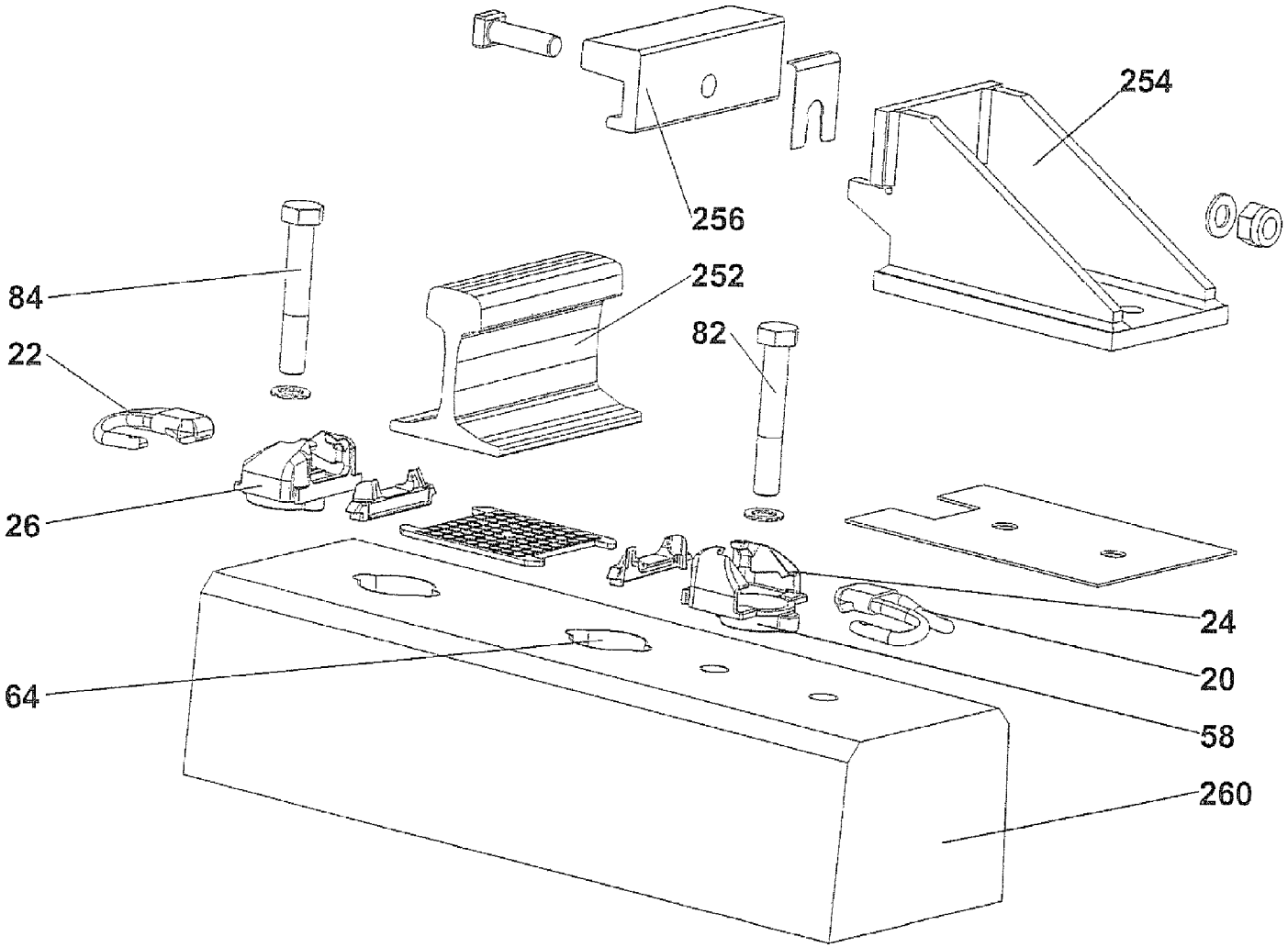
Figure 23:
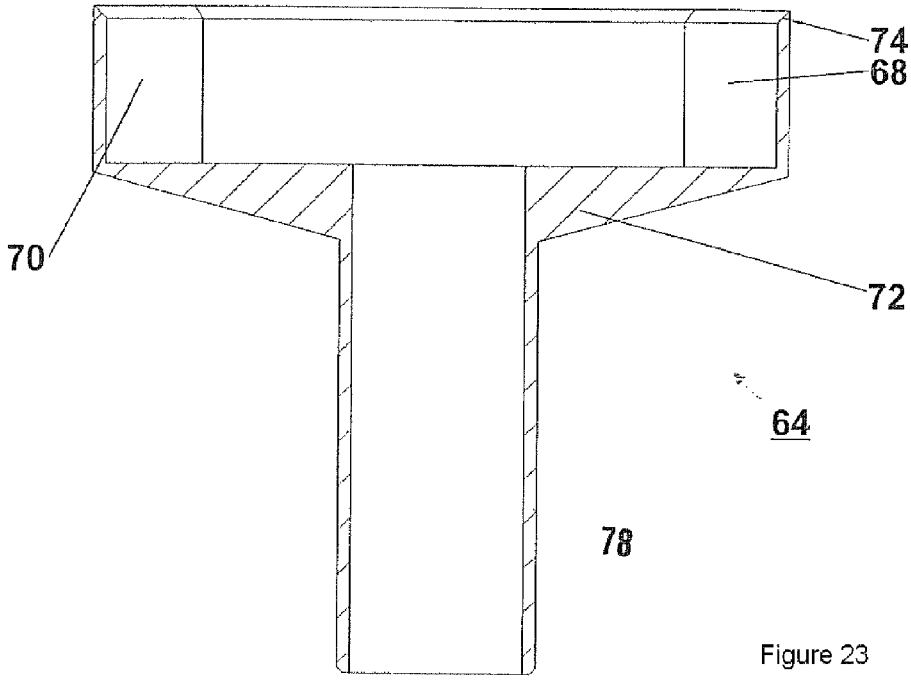
Figure 22:
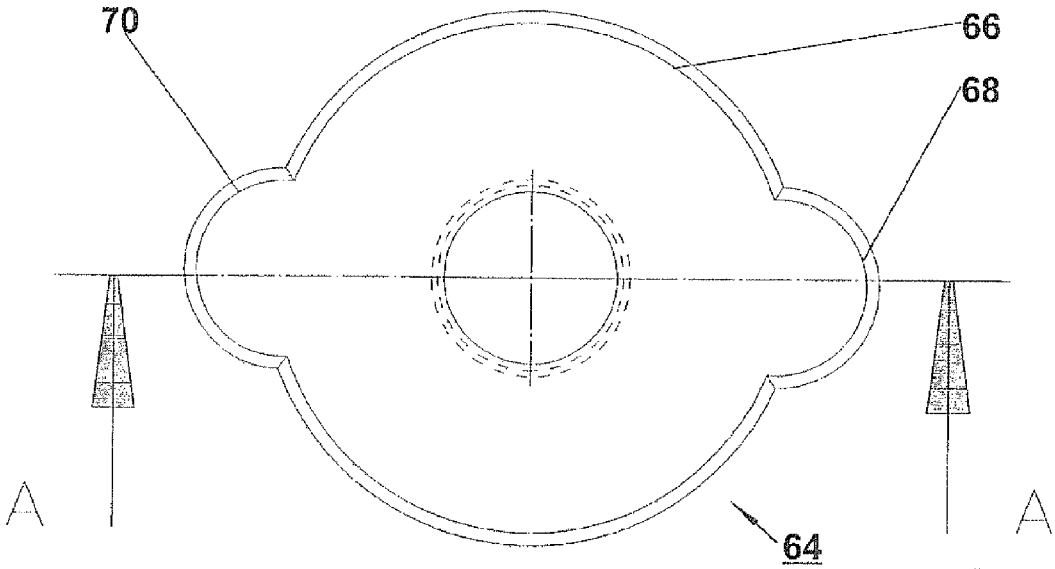
Figure 25:
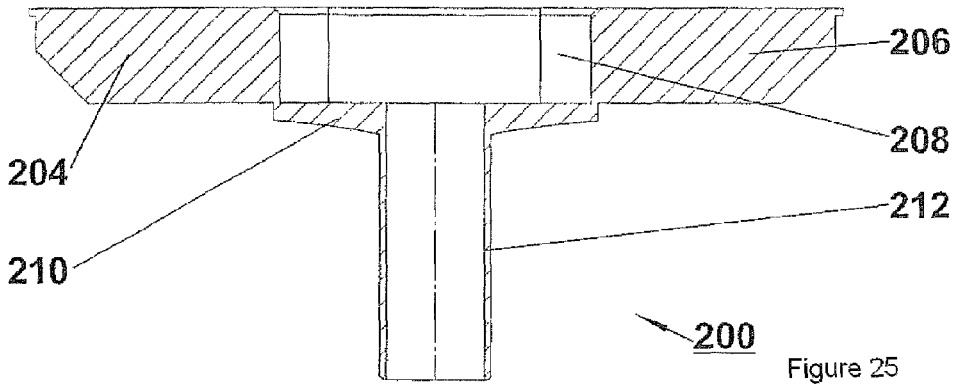
Figure 24:
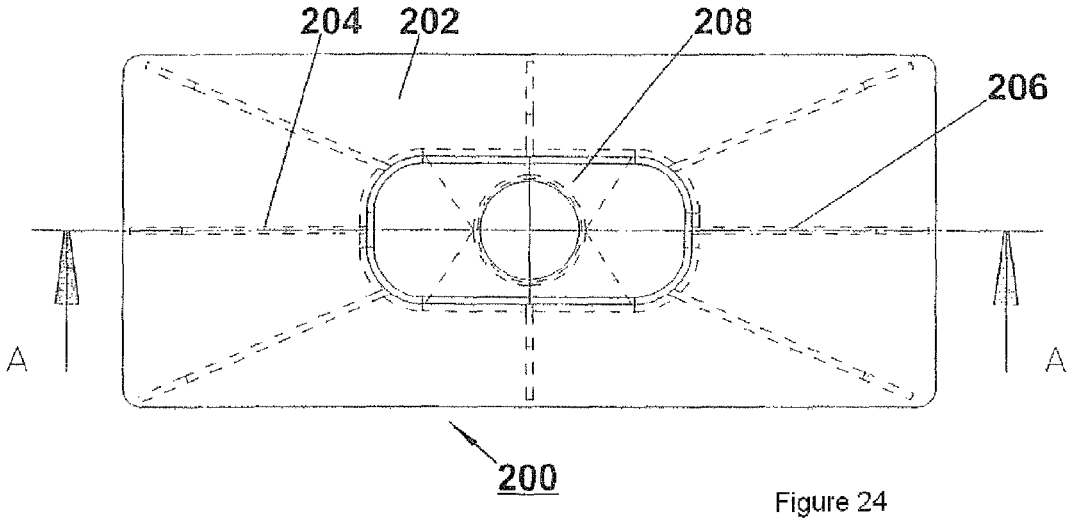
Figure 26:
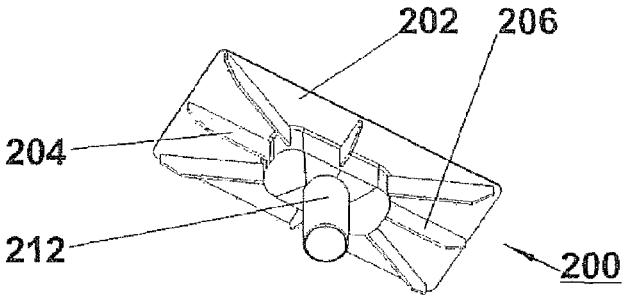
Figure 27:
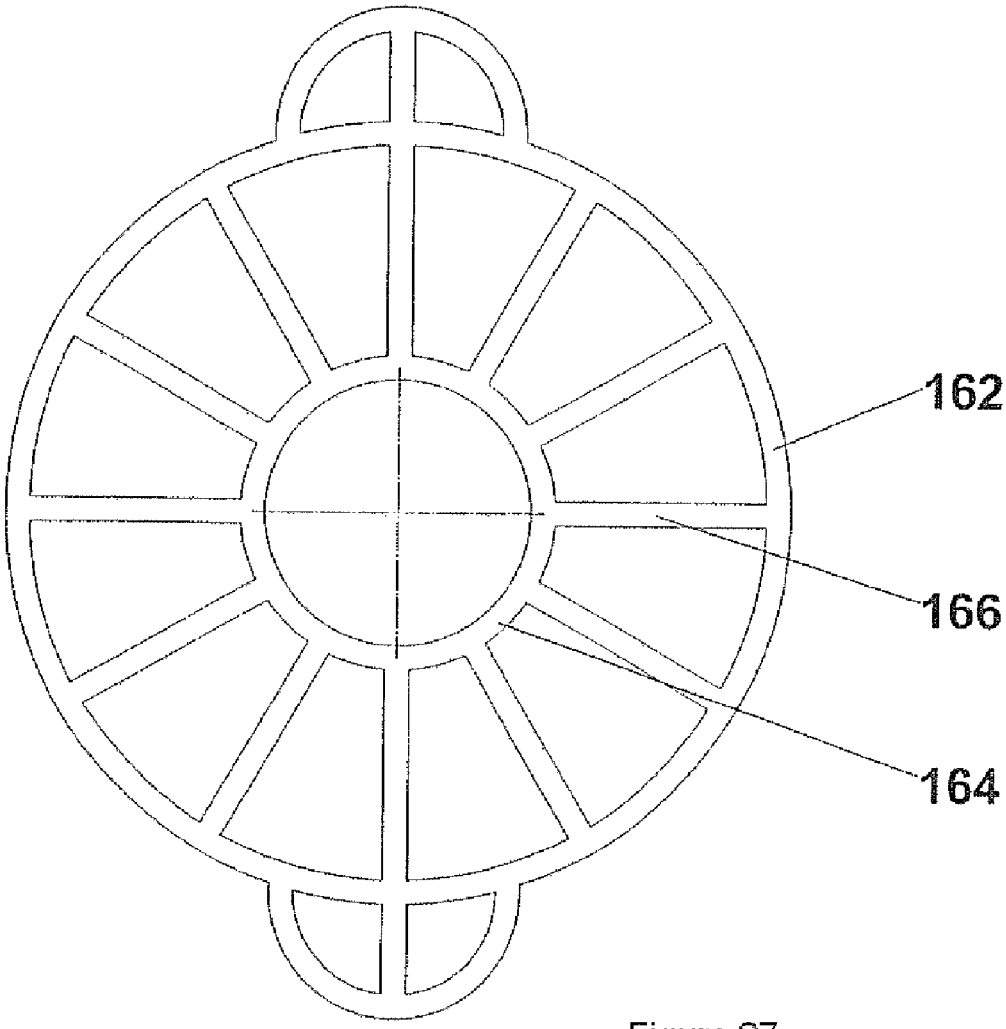

FIG. 3 shows a plan view of the assembled fastening system shown in FIG. 2, FIG. 4 shows a perspective view of the section according to FIGS. 2 and 3, FIG. 5 shows a section along the line B-B in FIG. 6, FIG. 6 shows a plan view of the view according to FIG. 5, FIG. 7 shows a perspective view of the section according to FIGS. 5 and 6, FIG. 8 shows a section along the line C-C in FIG. 9, FIG. 9 shows a plan view in the area of the section according to FIG. 8, FIG. 10 shows a perspective view of the section according to FIGS. 8 and 9, FIG. 11 shows a section along the line D-D in FIG. 12, FIG. 12 shows a plan view of the section according to FIG. 11, FIG. 13 shows a perspective view of the section according to FIGS. 11 and 12, FIG. 14 shows a section along the line E-E in FIG. 1, FIG. 15 shows a plan view of the section according to FIG. 14, FIG. 16 shows a perspective view of the section according to FIGS. 14 and 15, FIG. 17 shows an exploded view of the elements of the section according to FIGS. 2 to 4, FIG. 18 shows an exploded view of the elements according to FIGS. 5 to 7, FIG. 19 shows an exploded view of the elements according to FIGS. 8 to 10, FIG. 20 shows an exploded view of the elements according to FIGS. 11 to 13, FIG. 21 shows an exploded view of the elements according to FIGS. 14 to 16, FIG. 22 shows a plan view of a first embodiment of an insert, FIG. 23 shows a section along the line A-A in FIG. 22, FIG. 24 shows a plan view of a second embodiment of an insert, FIG. 25 shows a section along the line A-A in FIG. 24, FIG. 26 shows a perspective view of the section according to FIGS. 24 and 25 from underneath, and FIG. 27 shows a plan view of a spacer.

In the figures, where as a general principle the same reference numbers are used for identical elements, fastenings for rails running in a switch are shown. To fasten the rails, elastic clips and holders receiving the latter are used, as explained in principle in EP-B-0 619 852, in particular in FIGS. 1 to 5. To that extent reference is made to the disclosure in this respect. However, the invention is not restricted to these kinds of clamps, instead the teachings in accordance with the invention can also be achieved with clips of differing geometry and with clips received by holders which do not have shoulders to secure the clips, but a channel, for example, as known from the fastening according to AT-C-350 608. To that extent reference is made expressly to the disclosure in this respect.

FIG. 1 shows purely in principle a layout plan of a simple switch to the right. The rails here rest on concrete sleepers and are—purely as an example secured by so-called Pandrol® clips, as shown in EP-B-0 619 852.

FIGS. 2 to 4 and 17 are intended to make clear a standard fastening of a rail in the track or a stock rail 10 directly in front of the switch tip. The stock rail 10 rests in the usual way on an elastic intermediate layer or pad 12 arranged on the upper side 14 of a concrete sleeper 16. The stock rail 10 is secured by clips 20, 22 resting on its foot 18 and emanating from holders 24, 26.

The clips 20, 22 have in the plan view approximately the form of an M and comprise outer legs 28, 30 that pass via arc sections 32, 34 into inner legs 36, 38 which are in turn connected by an arc section 40. The outer legs 28, 30 are driven into the holders 24, 26, more precisely into so-called shoulders 42, 44, when the clips 20, 22 are fixed. On account of the curvature of the legs 28, 30, 32, 34, 36, 38, 40, the arc section 40 of the clip 20, 22 then rests with pre-tension on the rail foot 18 or the appropriate longitudinal edge 48, 50 and hence holds down the stock rail 10. Here the arc section 40 is surrounded by a sleeve 46 consisting of electrically insulating material in order to achieve an electrical separation between the clips 20, 22 and the stock rail 10.

While the principle design of the clips 20, 22 is explained solely on the basis of the clip 20, the same applies for the clip 22. Also the design of the holders 24, 26 is explained hereinafter using the example of the holder 24.

The holder 24 with the shoulders 42, 44 receiving the legs 28, 30 and each having a U-shaped channel 52, 54 open at the side for receiving the legs 28, 30, emanate from a base section 56 which in turn has on the bottom a disc-like shaped extension 58 which has projections 60, 62 on opposite sides. For assembly of the holder 24, 26, the shaped extension 58 is placed in an insert 64 geometrically matched to the shaped extension 58, comprising electrically insulating material and integrally cast in the concrete sleeper 16.

As the views in FIGS. 22 and 23 make clear, for positively receiving the shaped extension 58 the insert 64 has a circumferential wall 66 following a hollow cylinder and having in opposite areas protrusions 68, 70, so-called ears, that are geometrically matched to the projecting sections or projections 60, 62 of the shaped extension 58. The height of the insert 64, i.e. of its circumferential wall 66, matches the height of the shaped extension 58, so that the latter rests on the inner surface of a floor 72 of the insert 64 when the holder 24, 26 is assembled. The upper edge 74 of the insert 64 is flush or almost flush with the concrete sleeper 16, i.e. its surface 76, as made clear by FIGS. 2, 4 and 17.

The bottom 72 of the insert 64 is continued in a sleeve-like section 78 through which passes the shank 80 of a through-bolt 82, 84 when the holder 24, 26 is assembled. The sleeve-like section 78 has at the end side an extension 86 receiving a collar 88. Arranged inside the collar 88 and positively received by this is a nut 90 for tightening the bolt 82, 84 to the required extent and hence securing the holder 24, 26.

With regard to the through-bolt 82, 84 and its securing, reference is made to adequately known designs, as shown for example in DE-C-33 39 710.

With the holder 24, 26 assembled, the through-bolt 82, 84, i.e. its head 92, 94, is directly above the base section 56 of the holder 24, 26 without the possibility of obstructing the driving of the clip 20, 22 into the holder 24, 26, i.e. the insertion of the outer legs 28, 30 into the U-shaped channels 52, 54 or receptacles of the shoulders 42, 44.

With the holder 24, 26 assembled, the underside of the base section 56 rests evenly on the surface 76 of the concrete sleeper 16. Furthermore, the rail-side front area of the holder 24, 26 is covered at least in some sections by an insulator element 96, 98 that can be slid onto the holder 24, 26, as explained in EP-B-0 619 852.

In contrast with previously known rail fastenings, it is provided in accordance with the invention that the clips 20, 22 resting on the rail foot 12 or its longitudinal edges 48, 50 in order to fix the rail 10 do not emanate from holders permanently connected, for example integrally cast, to the concrete sleeper 16, but from the holders 24, 26 detachably connected to the concrete sleeper 16 which in turn can be positively inserted into inserts 64 consisting of electrically insulating material.

This insert 64 is fixed during casting of the concrete sleeper 16 to the bottom plate of the mould in order to ensure a definite orientation to the rail 10 to be fastened. Because the insert 64 and accordingly the shaped extensions 58 of the holder 24, 26 are geometrically matched to one another and positively engage into each other, the holder 24, 26 is also aligned with the rail 10 to be fastened such that the latter can be fixed to the required extent by the clips 20, 22.

The design of the detachable holder, from which emanates a clip, is feasible not only in the area of normal rails or in the area of the stock rail 10 preferably directly in front of the tongue, but also in the area of a tongue rail 100. In this area of the points, corresponding to the section B-B in FIG. 1, the stock rail 10 is arranged on a ribbed plate 102, i.e. not directly on a concrete sleeper 104.

The tongue rail rests on a slide chair 106 which has in the embodiment a U-shaped geometry with two side legs 108, 110 running along the concrete sleeper 104 and a transverse leg, non-referenced, running on the stock rail side.

The side legs 108, 110 limit a space in which an insert 116 having rollers 112, 114 can be adjustably arranged and fixed in the longitudinal direction of the concrete sleeper 104. Here the rollers 112, 114 protrude above the top of the insert 116 and the side legs 108, 110 to an extent that a sliding motion is made possible during adjustment of the tongue rail 110.

The slide chair 106 is detachably fixable to the ribbed plate 102 using bar spring elements 118, 120 running on the outside along the side legs 108, 110 and clampable using abutments 122, 124 of U-shaped section and emanating from the ribbed plate 102. The abutments 122, 124 run between supports 126, 128 of the slide chair 106 or its side legs 108, 110, on which the bar spring elements 118, 120 rest when the slide chair 106 is fixed.

The ribbed plate 102 is secured in the end area 130 on the slide chair side in the usual way using a through-bolt 132 that can be tightened using a nut 136 positively received by a collar 134 and located inside the concrete sleeper 104. In accordance with the explanations relating to the through-bolts 82, 84, the shank 138 of the through-bolt 132 is also surrounded by a sleeve 140 comprising an electrically insulating material and cast into the concrete sleeper 104.

The foot 18 of the stock rail 10 is held down by the slide chair 106 or by its transverse leg in its longitudinal edge area 48 on the right as illustrated. On the opposite side, the rail is fastened by an elastic clip 144 emanating from a holder 142, as explained in detail in connection with FIGS. 2, 3, 4 and 17. The holder 144 accordingly has channel-like receptacles 54 designed in U-shape in its shoulders 42, 44, in order to permit insertion or driving of the outer legs 30 of the clip 142 into the holder 144. The shaped extension 58 emanates from the base section 56 of the holder 144 and engages positively in an appropriately matched recess 146 in the ribbed plate 102. The holder 144 is fixed by the through-bolt 84. At the same time, the ribbed plate 102 is secured, since the base section 56 of the holder 144 rests in plane manner on the ribbed plate 102 outside the recess 146.

FIG. 8 reproduces a section C-C in the points according to FIG. 1 that runs in the area of the tongue heel. In this area, the tongue rail 100 rests on an intermediate plate 149 permitting a height increase for the concrete sleeper 148 and fixed on this intermediate plate. Here clips and holders are used, as explained in FIGS. 2 to 7, so that here too the same reference numbers are used for identical elements. Thus the clip 22 securing the stock rail 10 emanates from the holder 26, which is directly inserted into the concrete sleeper 148 in accordance with FIG. 2, positively in an insert 150 cast into the concrete sleeper 148 and corresponding to the insert 64, so that the corresponding reference numbers are used.

The clip 20 rests on the longitudinal edge 152 of the tongue rail foot 154 and facing away from the stock rail. The holder 24, i.e. its shaped extension 58 on the bottom, is inserted into a recess 156 of the intermediate plate 149, where the inner geometry of the recess 156 corresponds to the outer geometry of the shaped extension 58, so that positive engagement results. The recess 156 is here aligned flush with an insert 158 integrally cast in the concrete sleeper 148 and corresponding to the insert 64. For that reason, the same reference numbers are also used for identical elements.

The space between the bottom surface of the shaped extension 58 and the inner surface of the bottom 72 of the insert 158 is filled by a spacer 160 on which the shaped extension 58 rests when the through-bolt 82 is tightened. The spacer 160 accordingly has an outer geometry matching the insert 158 or the recess 156 in the intermediate plate 149 or the shaped extension 58 of the holder 24. This results from the plan view as per FIG. 27.

To design the spacer 160 stable yet lightweight, it is made of an annular outer wall 162 and an annular inner wall 164 running coaxially to this, both connected by radial webs 166. In all other respects, the design of the spacer 160 is clearly shown in FIG. 27.

To hold down or clamp the stock rail 10 and the tongue rail 100 at their facing longitudinal edges 48, 168 using appropriate clips as explained previously, a design is selected that has per se an inventive substance. For example, a holder 170 having a block-like base section 172 extends between the stock rail 10 and the tongue rail 100, from the bottom of which base section emanates a shaped extension 174 likewise having a block-like geometry with rounded edges, however of smaller cross-section. Viewed in the longitudinal direction of the rails 110, 100, two pairs of shoulders 176, 178 or 180, 182 run at a distance from one another and—like the previously explained holders 24, 26—each form channel-like receptacles of U-shaped section for the outer legs of clips 184, 186, which have a design and function matching those of the clips 20, 22.

An intermediate plate 188 describable as a bridge element extends between the shoulders 176, 178 on the one side and 180, 182 on the other side, and is adjustable relative to the holder 170 and rests with edge sections 194, 196, limited by steps 190, 192, on the rail foot 18 or 154 of the stock rail 10 or tongue rail 100 or their longitudinal edges 48, 168, as shown in particular by the sectional view in FIG. 8. The middle legs of the clips 184, 186 then rest on the surface 198 of the intermediate plate 188, whereby the intermediate plate 188 is pressed onto the rail feet 18, 154.

As a result, rails running closely next to one another, i.e. in the embodiment the stock rail 10 and the tongue rail 100, can be clamped in space-saving manner using clips used in the remaining area of the points.

As regards holding down, to ensure identical geometrical conditions as when direct resting on a rail foot, the intermediate plate 188 has on the surface side preferably a roof-like geometry with inclination angles matching those of the supporting surfaces of the rail feet 18, 154 in those areas in which the clips usually rest.

The holder 170 emanates in accordance with the holders 24, 26 from an insert 200 that is cast into the concrete sleeper 148 and that is shown in self-explanatory form in FIGS. 24 to 26. The insert 200 thus has a disc-like base section 202 having a surface extent matching that of the base section 172 of the holder 170. This means that when the holder 170 is fixed, it rests entirely on the base section 202 of the insert 200 and hence is electrically insulated from the concrete sleeper 148, since the insert 200 comprises electrically insulating material.

In order to design the base section 202 with sufficient stiffness, reinforcing ribs emanate from its underside and are exemplary provided with the reference numbers 204 and 206. A recessed area 208 with a geometry matched to the shaped extension 174 of the holder 170 is provided in the center of the base section 202 so that as a result the holder 170 interacts positively with the insert 200. A sleeve 212 then emanates from the bottom 210 of the recessed area 208 and can be passed through by a through-bolt 214 or its shank 216, as was explained in connection with the through-bolts 82 and 84. Accordingly, the through-bolt 214 is also secured in the concrete sleeper by a nut 218 that is positively received by a sleeve 220 which is connected to the tube 212 and provided in the concrete sleeper 148. Other technical solutions having the same effect are also possible.

A so-called double fastening, as explained in connection with the holder 170 and the stock rail and tongue rails 10, 100 running directly adjacent to one another, is also shown in section D-D in FIG. 1 and explained using the FIGS. 11, 12, 13 and 20. Here the same reference numbers are also used as a general principle for already explained elements.

The rail sections 222 and 224 merging into the tongue rails or wing rails are held down on the outside by holders detachably arranged in a concrete sleeper 226 and matching the holders 24, 26 according to FIGS. 2, 3, 4 and 17. The corresponding holders 24, 26 are also positively received by inserts 64 integrally cast in the concrete sleeper 226. To that extent no further explanations are required. Rather, reference is made to the embodiments in FIGS. 2 to 4 and in FIG. 17.

The facing longitudinal edges 228, 230 of rail sections 224, 226 are by contrast held down by clips and an intermediate plate or bridge element, as explained in connection with FIGS. 8, 9, 10 and 19. In other words, a holder 232 is between the rails 222, 224, from which holder emanate two pairs of shoulders 234, 236, 238, 240 with channel-like receptacles, not shown in detail, for outer legs of clips matching the clips of the previously described type, i.e. the clips 184, 186, such that the corresponding reference numbers are used. The holder 232, matching in its design the holder 170, also has a block-like base section 172 with shaped extension 174 that positively engages in an insert integrally cast in the concrete sleeper 226 and matching the insert 200.

An intermediate plate 242 describable as a bridge element runs transversely to the holder 232 and exercises the function of the intermediate plate 188 in accordance with FIGS. 8, 9, 10 and 19. Accordingly, the intermediate plate 242, which has a geometry of U-shaped section, is a separate construction element that is placed on the holder 232 or its base section 172, where the intermediate plate 242 has corresponding web-like projections 244, 246 for proper orientation to the holder 232, with the clear distance between the projections being equal to the width of the base section 172 of the holder 232. With its lateral edges 248, 250 the intermediate plate 242 is then positioned on the longitudinal edges 228, 230 of the rail sections 222, 224 in order to then insert or drive the clips 184, 186 into the holder 232, i.e. the shoulders 234, 236, 238, 240. In this way, the rails 222, 224 are clamped on the inside.

A sectional view E-E according to FIGS. 14 to 16 and 21 reproduces the situation in the area of the check rails. Here the rail 252, along which support plates 254 are arranged for receiving check rail inserts 256, is secured by holders or clips matching the design according to FIGS. 2 to 4 and 17, i.e. a situation corresponding to that outside the points. In other words, the rail section 252 or its foot 258 are held down using clips emanating from holders which are detachably arranged in a concrete sleeper, so that the same reference numbers can be used corresponding to FIGS. 2 to 4 and 17. Express reference is also made to the explanations in this respect.

In other words, the inserts 24, 26 emanate from inserts 64 integrally cast in the concrete sleeper 260 in which the former positively engage with the respective shaped extension 58. The holders 24, 26 are then secured to the concrete sleeper 260 by means of through-bolts 82, 84. The trestle plate 255 too is connected to the concrete sleeper in accordance with the view in the drawing using through-bolts 262, 264, as was exemplary explained in connection with FIGS. 2 to 4 and 17.

It should be furthermore mentioned that pads/intermediate layers as shown in the drawings are arranged to the required extent between the individual construction elements and the concrete sleepers in order to permit the required elasticity and electrical insulation or sliding adjustment of the tongue rail. To that extent however, reference is made to measures adequately known from the superstructure.

10 stock rail
12 pad
14 upper side
16 concrete sleeper
18 foot
20 clip
22 clip
24 holder
26 holder
28 outer leg
30 outer leg
32 arc section
34 arc section
36 inner leg
38 inner leg
40 arc section
42 shoulder
44 shoulder
46 sleeve
48 longitudinal edge
50 longitudinal edge
52 channel
54 channel
56 base section
58 shaped extension
60 projection
62 projection
64 insert
66 circumferential wall
68 protrusion
70 protrusion
72 bottom
74 upper edge
76 surface
78 sleeve-like section
80 shank
82 through-bolt
84 through-bolt
86 extension
88 collar
90 nut
92 head
94 head
96 insulating element
98 insulating element
100 tongue rail
102 ribbed plate
104 concrete sleeper
106 slide chair
108 side leg
110 side leg
112 roller
114 roller
116 insert
118 bar spring element
120 bar spring element
122 abutment
124 abutment
126 support
128 support
130 end area
132 through-bolt
134 collar
136 nut
138 shank
140 sleeve
142 holder
144 clip
146 recess
148 concrete sleeper
149 intermediate plate
150 insert
152 longitudinal edge area
154 foot
156 recess
158 insert
160 spacer
162 outer wall
164 inner wall
166 web
168 longitudinal edge
170 holder
172 base section
174 shaped extension
176 shoulder
178 shoulder
180 shoulder
182 shoulder
184 clip
186 clip
188 intermediate plate
190 step
192 step
194 edge section
196 edge section
198 surface
200 insert
202 base section
204 reinforcing rib
206 reinforcing rib
208 recessed area
210 bottom
212 sleeve
214 through-bolt
216 shank
218 nut
220 collar
222 rail section
224 rail section
226 concrete sleeper
228 longitudinal edge
230 longitudinal edge
232 holder
234 shoulder
236 shoulder
238 shoulder
240 shoulder
242 intermediate plate
244 projection

246 projection
248 lateral edge
250 lateral edge
252 rail
254 trestle
255 trestle plate
256 check rail insert
258 foot
260 concrete sleeper
262 through-bolt
264 through-bolt

The invention claimed is:

1. Arrangement for fastening of rails (10, 100, 222, 224, 252) having rail feet (18, 154, 258) and resting on concrete sleepers (16, 104, 148, 226, 260) in the area of a points or crossing comprising several clips (20, 22, 144, 184, 186) emanating from holders (24, 26, 142, 170, 232) with at least first and second legs, where the first legs (28, 30) of the clips are fixed inside one or more receptacle means by the respective holders and the second legs (36, 38, 40) of at least some of the clips rest on the rail feet, wherein first holders (24, 26) are positively received by first inserts (64) integrally cast in concrete sleepers (16, 148, 226, 260) and detachably connected to the concrete sleepers by bolt elements (82, 84), wherein second holders (142) are positively arranged in recesses (146) of plate elements (102) arranged on concrete sleepers (104) and are detachably connected to the concrete sleeper by bolt elements (84) and/or that third holders (24) are positively arranged in through openings (156) provided in intermediate plates (149) supporting heel area of a tongue rail (100), supported on the bottom by spacer elements (160) and detachably connected to concrete sleepers using bolt elements (82), and wherein fourth holders (170, 232) are each arranged between rails (10, 100; 222, 224) running directly next to one another, wherein the fourth holders are positively received by second inserts (200) integrally cast in concrete sleepers (148, 226) and detachably connected to the concrete sleepers using bolt elements (214), and wherein two clips (184, 186) emanate from every fourth holder and each rest on a second intermediate plate (188, 242) arranged movable relative to the fourth holder and in turn rest on the rail feet (18, 48, 154, 228, 230) running directly next to one another.

2. Arrangement according to claim 1, wherein the first, second and third holder (24, 26, 142) are of identical design.

3. Arrangement according to claim 1, wherein at least one first holder (24, 26) emanates from each concrete sleeper (16, 104, 148, 226, 260).

4. Rail fastening for securing a rail (10, 100, 222, 224, 252) whose foot (18, 154, 258) rests on a concrete sleeper (16, 104, 148, 226, 260) or on a plate element (102,149) resting on said sleeper, comprising at least one elastic clip (20, 22, 144, 184, 186) having several legs (28, 30, 32, 34, 36, 38, 40) of which at least one leg extends inside a receptacle 42,44,134,236, 238, 240, 176, 178, 180, 182) of a holder that is connected to the concrete sleeper, and at least one further leg rests on the rail foot, and where the holder (24, 26, 142, 170, 232) is arranged in the concrete sleeper (16, 104, 148, 226, 260) or in said plate element resting on said sleeper, and wherein the holder (24, 26, 142, 170, 232) is detachably inserted in an insert (64, 160, 200) comprising electrically insulating material and said insert being cast integrally into the concrete sleeper (16, 104, 148, 226, 260) and bolt means for securing said holder to said concrete sleeper, and wherein said holder has a base section (56, 172) with a shaped extension (58, 174) on the bottom and positively engaging in the insert (64, 116, 150, 158, 200) and wherein the shaped extension has a cylinder disc geometry with a circumferential area from which emanates at least one projection (60, 62).

5. Rail fastening according to claim 4, wherein the insert (64, 160, 200) has in a plane running parallel to the surface of the concrete sleeper (16, 104, 148, 226, 260) a cross-section differing from a circular geometry and wherein the holder (24, 26, 142, 170, 232) positively engages in the insert.

6. Rail fastening according to claim 4 wherein two shoulders (42, 44) each receiving a leg section (28, 30) of the clip (20, 22) emanate from the base section (56) of the holder (24, 26) and wherein the bolt element(82, 84) passes between the shoulders, where the head (92, 94) of the bolt element is underneath the clip or its section resting on the rail foot (18, 154, 228, 230, 258) when the holder is connected to the concrete sleeper (16, 104, 148, 226, 260).

7. Rail fastening according to claim 4, wherein the insert (64, 200) comprises a first section receiving the shaped extension (58, 174) and a second sleeve-like section (78) extending in the concrete sleeper (16, 104, 148, 226, 260), passed through by the bolt element (82, 84) and emanating from the first section.

8. Rail fastening according to claim 4, wherein the first section of the insert (64) has a hollow cylinder geometry with two radial protrusions (68, 70) having a circular geometry in section.

9. Rail fastening according to claim 4, wherein the plate element is a ribbed plate (102) in which the holder (144) positively engages.

10. Rail fastening according to claim 4, wherein the plate element is an intermediate plate (149) supporting a tongue rail (100) in its root area and having a through opening (156) with a cross-section matching that of the shaped extension (58), and wherein on the bottom a spacer element (160) comprising electrically insulating material is arranged in the through opening and supports the holder (24) or its shaped extension (58).

11. Rail fastening according to claim 10, wherein the spacer element (160) has an outer and inner wall (162, 164) following a circular geometry in section and connected by radial webs (166).

12. Rail fastening according to claim 4, wherein the holder (170, 232) is arranged between two rails (10, 100; 222, 224) running directly next to one another, wherein receptacles for two clips (184, 186) emanate from the holder, wherein the clips rest on a plate element (188, 242) adjustable relative to the holder, and wherein the plate element in turn rests on the rail feet (18, 154) of the rails.

13. Rail fastening according to claim 4, wherein two pairs of shoulders (176, 178, 180, 182, 234, 236, 238, 240) emanate from the holder (142, 232), wherein a clip (184, 186) emanates from each pair of shoulders and wherein the plate element (188, 242) resting on the rail feet runs between the two pairs of shoulders.

14. Rail fastening according to claim 4, wherein the plate element (188, 242) between the rails (10, 100, 222, 224) running directly next to one another and resting on their feet has supporting surfaces with an inclination matching inclination of the rail feet (18, 154, 258) in areas which usually support clips.

15. Rail fastening according to claim 4, wherein the holder (170, 232) arranged between the rails (10, 100, 222, 224) running directly next to one another has a base section (172) of block-like geometry and wherein the shaped extension (174) emanating from the bottom surface of said base section has a geometry rectangular in section with rounded corners that positively engages in the insert (200).

16. Rail fastening according to claim 15, wherein the holder arranged between the rails running directly next to one another is arranged in an insert (200) which comprises a plane section (202) merging flush or almost flush with the surface (198) of the concrete sleeper (148, 226) and whose surface extent is greater than that of the base section (172) of the holder (70) and wherein a recessed area (208) positively receiving the shaped extension (174) of the holder is in the center of the outer section, from which recessed area emanates a sleeve-like section (212) passed through by the bolt element (214).

17. Rail fastening according to claim 16 wherein the outer section (202) of the insert (200) has on the underside radial reinforcing ribs (204, 206).

18. Arrangement according to claim 4, wherein said receptacle consists of a shoulder (42, 44, 134, 236, 238, 240, 176, 180, 182).

19. Arrangement according to claim 4, wherein said receptacle consists of a channel of a holder (24, 26, 142, 170, 232).

20. Rail fastening for securing a rail (10, 100, 222, 224, 252) whose foot (18, 154, 258) rests on a concrete sleeper (16, 104, 148, 226, 260) or on a plate element (102,149) resting on said sleeper, comprising at least one elastic clip (20, 22, 144, 184, 186) having several legs (28, 30, 32, 34, 36, 38, 40) of which at least one leg extends inside a receptacle 42,44,134, 236, 238, 240, 176, 178, 180, 182) of a holder that is connected to the concrete sleeper, and at least one further leg rests on the rail foot, and where the holder (24, 26, 142, 170, 232) is arranged in the concrete sleeper (16, 104, 148, 226, 260) or in said plate element resting on said sleeper, and wherein the holder (24, 26, 142, 170, 232) is detachably inserted in an insert (64, 160, 200) comprising electrically insulating material and said insert being cast integrally into the concrete sleeper (16, 104, 148, 226, 260) and bolt means for securing said holder to said concrete sleeper, and wherein said holder has a base section (56, 172) with a shaped extension (58, 174) on the bottom and positively engaging in the insert (64, 116, 150, 158, 200) and wherein the shaped extension has a cylinder disc geometry with a circumferential area from which at least one recess emanates.

* * * * *